US005368502A

United States Patent [19]

Lin

[11] Patent Number: 5,368,502

[45] Date of Patent: * Nov. 29, 1994

[54] PLUG - IN MICROPHONE CONNECTOR

[75] Inventor: Jia S. Lin, Tainan, Taiwan, Prov. of China

[73] Assignee: New Tide Enterprise Co., Ltd., Tainan, Taiwan, Prov. of China

[ * ] Notice: The portion of the term of this patent subsequent to Aug. 9, 2011 has been disclaimed.

[21] Appl. No.: 151,232

[22] Filed: Nov. 12, 1993

Related U.S. Application Data

[63] Continuation-in-part of Ser. No. 47,953, Apr. 19, 1993.

[51] Int. Cl.[5] ..... H01R 13/58

[52] U.S. Cl. ..... 439/462

[58] Field of Search ..... 439/461, 462

[56] References Cited

U.S. PATENT DOCUMENTS 4,647,127 3/1987 Weingartner ..... 439/289

4,657,327 4/1987 Weingartner ..... 439/289

FOREIGN PATENT DOCUMENTS 172779 2/1986 European Pat. Off. ..... 439/461

*Primary Examiner*—Gary F. Paumen

[57] ABSTRACT

A plug-in microphone connector which includes a connector member, a connector housing engaging with the connector member by a female thread and a male thread to compress a cable put through the connector member and a cable pincher so that the cable bends a little along a curved surface of the cable pincher to be sufficiently pinched therein to prevent separation of the cable from the connector member.

6 Claims, 2 Drawing Sheets

PLUG - IN MICROPHONE CONNECTOR

This invention is a continuation-in-part of U.S. patent application Ser. No. 08/047,953 filed 4/19/93, now pending.

BACKGROUND OF THE INVENTION

Known microphone connectors of U.S. Pat. Nos. 4,647,127 and 4,657,327 have a cable pinching method wherein a ring 26 engages a connector member 13, forcing a tubular clamping sleeve 7 to open its rear end 8 for clamping a cable. However, the clamping sleeve is tubular, so a great force has to be used to engage a female thread of a terminal with a housing in clamping a large diameter cable in the clamping sleeve. And continuous work of using such a great force in assembling this kind of microphone connector may compel a worker to be extremely tired. The worker may feel pain or experience swelling of his right thumb after working to engage thirty or forty of those connectors, and has to stop his work.

Summary Of The Invention

This invention has an object to offer a plug-in microphone connector with features listed below.

1. It is provided with a cable pincher shaped to conform to a connector member.

2. The cable pincher has a pinching block with an upper surface shaped as recessed and curved for a cable to lie thereon closely bending up to be tightly pinched.

3. The pinching block has two pinching points of the outer end of the upper surface to stick in the surface of a cable to reinforce pinching of the cable.

DETAILED DESCRIPTION OF THE INVENTION

Figure 1:
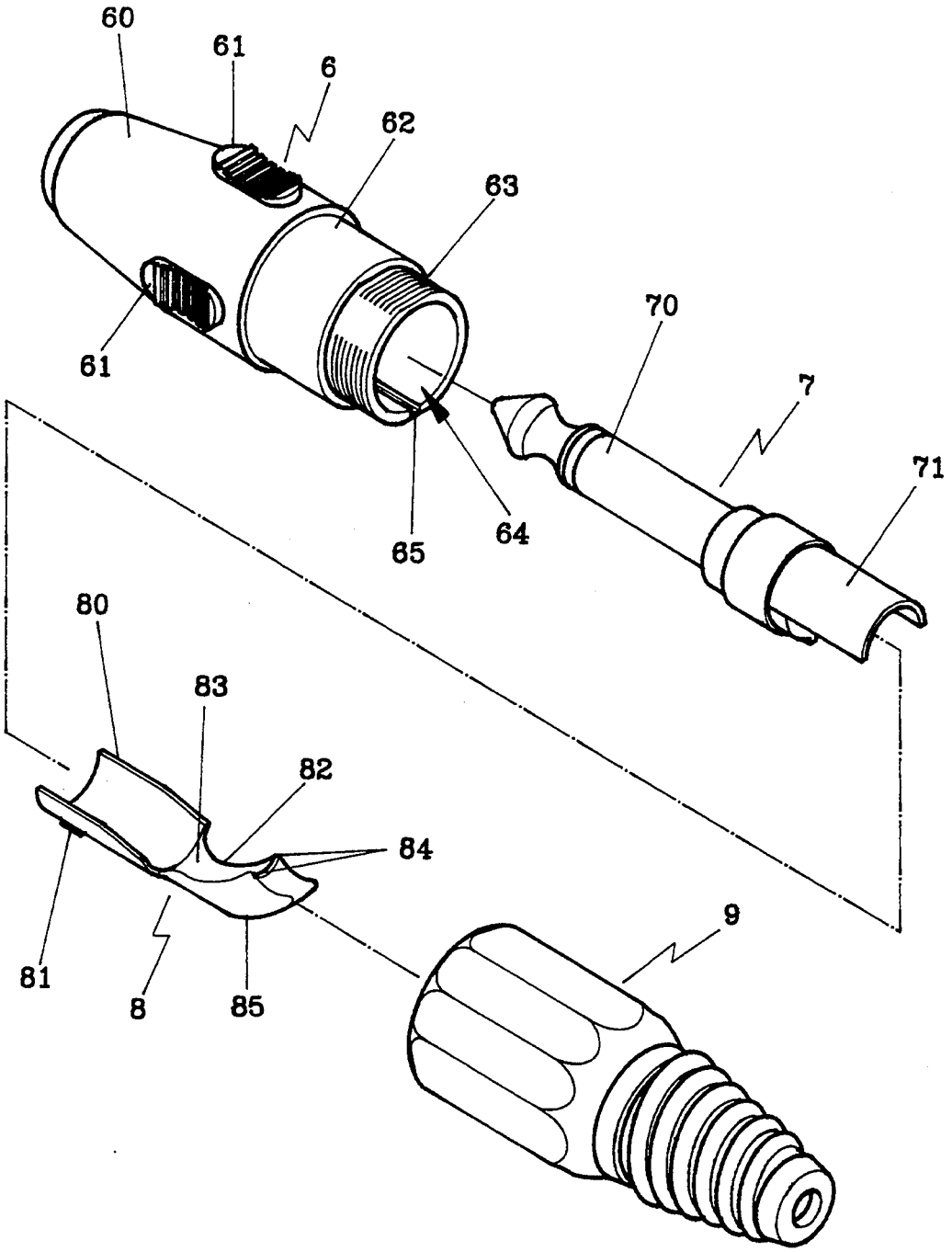
FIG. 1 is an exploded perspective view of a plug-in microphone connector in the present invention.

A plug-in microphone connector in the present invention, as show in FIGS. 1–4, which comprises a connector member 6, a plug 7, a cable pincher 8 and a connector housing 9 as main components.

The connector member 6 has a long proximal hand holding portion 60 with four curved grips 61 for fingers to grip thereon, an intermediate smooth portion 62, a distal male-threaded portion 63, and an axially extending through hole 64 for an inserting potion 70 of the plug 7 to pass through, and a lengthwise groove 65

The plug 7 has an inserting portion 70 and an inner semi-round end forming a cylindrical wall together with a semi-round wall 80 of the cable pincher 8 for pinching a cable therein.

The cable pincher 8 has a semi-round wall 80, a combining block 81 at a bottom to fit within the groove 65 of the connector member 6 to eliminate rotation of the plug 7, a pinching block 82 having a recessed and curved surface 83 and two pinching points 84 on an outer end, and a curved-up bottom surface 85.

The connector housing 9 has a female-threaded portion to engage the male-threaded portion 63 of the connector member 6, a compact ring 90 urging the cable pincher 8 and to let the pinching points 84 stick in the cable 4, for attaining the purpose of pinching securely the cable 4.

Figure 2:
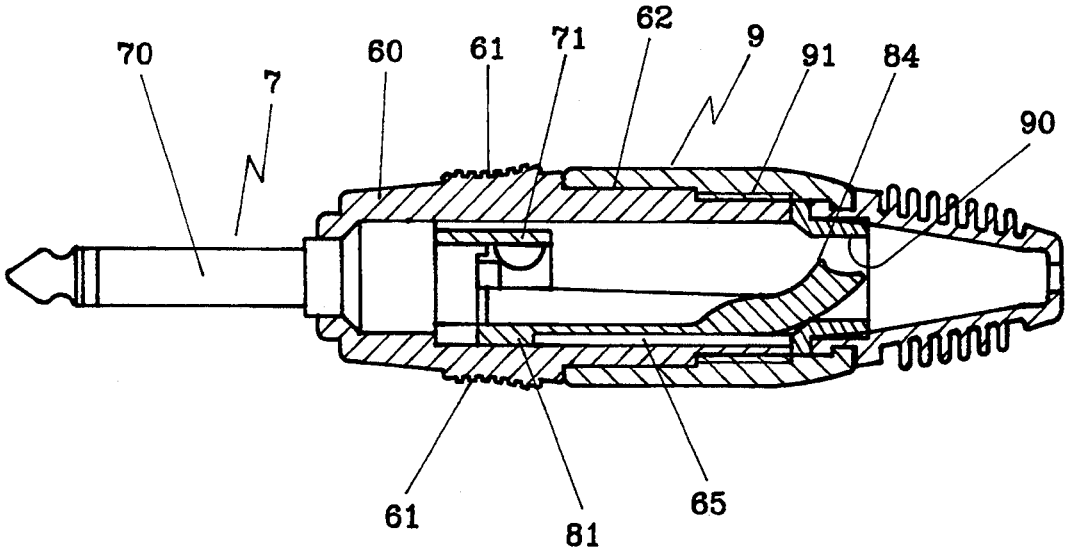
FIG. 2 is a cross-sectional view of the plug-in microphone connector in the present invention.
Figure 3:
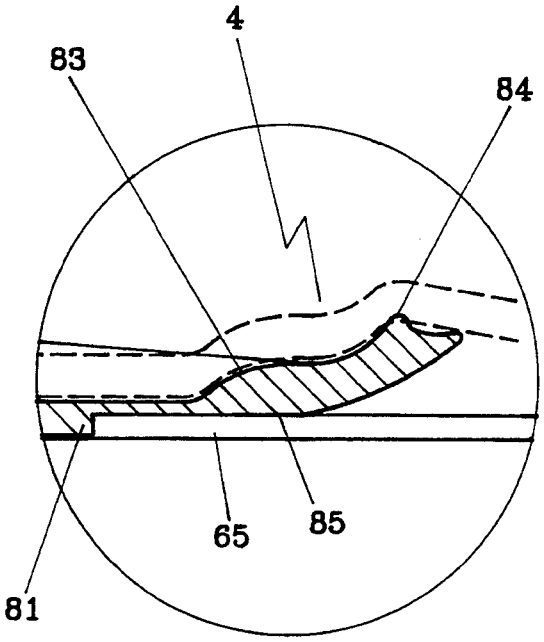
FIG. 3 is a magnified cross-sectional view of a cable pincher of the plug-in microphone connector in the present invention.
Figure 4:
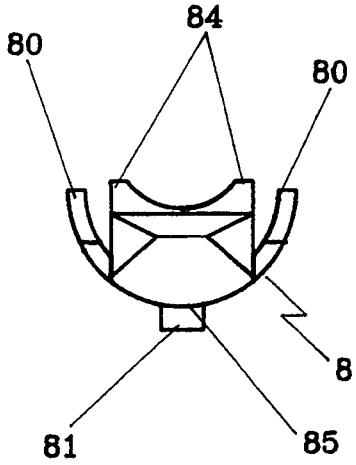
FIG. 4 is a rear view of the cable pincher of the plug-in microphone connector in the present invention.

Therefore, after the cable 4 is put through the pincher 8, the connector housing 9 is screwed with the connector member 6, by engaging the female-thread 91 with the male thread 63. Then the cable 4 can be bent up a little where there is a compact ring 90 in the connector housing 9, as shown in FIGS. 2 and 3, after the cable 4 is placed through the cable pincher 8 and the connector housing 9 is screwed onto the connector member 6. In addition, the pinching points 84 stick in the outer surface of the cable 4, which then is difficult to pull off.

What is claimed is:

1. A plug-in microphone connector comprising;

a connector member shaped cylindrically, having at least a proximal hand holding portion, an intermediate smooth portion, a distal male-threaded portion to engage a female-threaded portion of a connector housing, and an axially extending through hole for depositing a plug and a cable pincher therein;

a plug having an inserting portion and an inner semi-round end forming a cylindrical wall together with a semi-round wall of the cable pincher for pinching a cable therein;

a connector housing having a female-threaded portion to engage the male-threaded portion of the connector member and a discrete compact ring on an inner surface of the connector housing;

a cable pincher having an annular wall with a slot for depositing cable of various sizes through the annular wall, a pinching block extending lengthwise from the wall and having a recessed and curved surface and two pinching points on an outer end thereof, and upper and bottom surfaces gradually curving up to the outer end; and said compact ring in said connector housing compressing the upper surface of said cable pincher after the connector housing is combined with the connector member, said pinching points of the cable pincher then sticking in the surface of said cable and said cable being forced to bend inward slightly according to the curvature of said pinching block of the cable pincher so that the cable pincher may sufficiently pinch the cable so as to render it immobilized and inseparable.

2. The plug-in microphone connector as claimed in claim 1, wherein said cable pincher is provided with a vertical semi-round wall to coordinate with said semi-round surface of said plug for pinching said cable.

3. The plug-in microphone connector as claimed in claim 1, wherein said cable pincher has a pinching block with an upper surface shaped as recessed and curved to conform to a round outer surface of said cable.

4. The plug-in microphone connector as claimed in claim 1, wherein said cable is compressed by said compact ring of the connector housing and said cable pincher bending inward slightly to be pinched very effectively.

5. The plug-in microphone connector as claimed in claim 1, where in said proximal hand holding portion of the connector member has more than two grips.

6. The plug-in microphone connector as claimed in claim 1, wherein said intermediate smooth portion is longer than said distal male-threaded portion.

* * * * *